US011218789B1

(12) United States Patent
Ko et al.

(10) Patent No.: US 11,218,789 B1
(45) Date of Patent: Jan. 4, 2022

(54) MICROPHONE-MOUNTED EARPHONE

(71) Applicant: ALMUS Corp., Chungcheongnam-do (KR)

(72) Inventors: Ju Heon Ko, Gyeonggi-do (KR); Jong Won Lee, Incheon (KR); Byung Il Min, Gyeonggi-do (KR); Yun Uk Ha, Incheon (KR); Jeong Kwon Park, Gyeonggi-do (KR); Yeong Jae Lee, Gyeonggi-do (KR)

(73) Assignee: ALMUS Corp., Chungcheongnam-do (KR)

( * ) Notice: Subject to any disclaimer, the term of this patent is extended or adjusted under 35 U.S.C. 154(b) by 0 days.

(21) Appl. No.: 16/988,966

(22) Filed: Aug. 10, 2020

(30) Foreign Application Priority Data

Jul. 2, 2020 (KR) ..... 10-2020-0081778

(51) Int. Cl.
*H04R 1/08* (2006.01)
*H04R 1/10* (2006.01)

(52) U.S. Cl.
CPC ..... *H04R 1/086* (2013.01); *H04R 1/1016* (2013.01); *H04R 1/1075* (2013.01)

(58) Field of Classification Search
CPC ... H04R 1/00; H04R 1/02; H04R 1/08; H04R 1/083; H04R 1/086; H04R 1/10; H04R 1/1058; H04R 1/1075; H04R 1/1016; H04R 1/28; H04R 1/12846; H04R 1/12823
See application file for complete search history.

(56) References Cited

U.S. PATENT DOCUMENTS

2010/0316225 A1* 12/2010 Saito ..... H04R 1/1083 381/56
2013/0028462 A1* 1/2013 Chen ..... H04R 1/1083 381/375
2014/0153733 A1* 6/2014 Llewellyn ..... H04R 1/10 381/71.6
2018/0098143 A1* 4/2018 Silvestri ..... H04R 1/04
2019/0327550 A1* 10/2019 Linden ..... H02J 7/0044

FOREIGN PATENT DOCUMENTS

KR 10-2017-0123818 A 11/2017
KR 10-2020-0069650 A 6/2020

OTHER PUBLICATIONS

Office Action from corresponding Korean Patent Application No. 10-2020-00081778, dated Apr. 30, 2021.

* cited by examiner

*Primary Examiner* — Thang V Tran
(74) *Attorney, Agent, or Firm* — Harness, Dickey & Pierce, P.L.C.

(57) ABSTRACT

Disclosed is a microphone-mounted earphone including a housing, a speaker unit accommodated in the housing, and a microphone. Here, the housing includes a sound emission path formed in front of the speaker unit to emit a sound generated by the speaker unit toward the outside. The housing includes a microphone installation groove recessed from an outer surface of a front of the speaker unit toward the sound emission path. The microphone is installed in the microphone installation groove. Also, the microphone-mounted earphone further includes a cover configured to cover the microphone installation groove not to allow the microphone to be exposed outward.

8 Claims, 9 Drawing Sheets

MICROPHONE-MOUNTED EARPHONE

CROSS-REFERENCE TO RELATED APPLICATION

This application claims priority to and the benefit of Korean Patent Application No. 2020-0081778, filed on Jul. 2, 2020, the disclosure of which is incorporated herein by reference in its entirety.

FIELD

The present invention relates to an earphone, and more particularly, to a microphone-mounted earphone configured to perform an active noise canceling (ANC) function.

BACKGROUND

Generally, an earphone is an electronic device and/or additional device which includes a miniaturized speaker unit built therein and is put in an ear (for example, an external auditory meatus) of a user and capable of directly releasing a sound generated at the speaker unit toward an inside of the ear so as to allow the user to hear the sound with low power. The user may comfortably listen to music and the like without regard to ambient conditions by using the earphone being coupled to an electronic device such as a mobile communication terminal, a portable multimedia player, a tablet computer, and the like.

Recently, earphones to which active noise cancellation (ANC) technology is applied to remove ambient noise components while listening have gotten the spotlight. ANC is a technique of collecting noise input from the outside using a microphone, generating a signal having a phase difference of 180 degrees with respect to the collected noise, and removing noise components by overlapping of the signal.

To perform an ANC function, it is necessary to mount a microphone in an earphone. When an additional space for mounting the microphone is provided or a separate component for mounting the microphone is added, it causes a difficulty in miniaturizing or assembling the earphone. Also, sound quality may be deteriorated by the microphone and a mounting structure thereof.

SUMMARY

The present invention is directed to providing a microphone-mounted earphone capable of facilitating miniaturization and assembling of the earphone and of minimizing deterioration in sound quality caused by a microphone and a mounting structure thereof.

Aspects of the present invention are not limited to the above-stated aspect and other unstated aspects of the present invention will be understood by those skilled in the art from a following description.

According to an aspect of the present invention, there is provided a microphone-mounted earphone including a housing, a speaker unit accommodated in the housing, and a microphone. Here, the housing includes a sound emission path formed in front of the speaker unit to emit a sound generated by the speaker unit toward the outside. The housing includes a microphone installation groove recessed from an outer surface of a front of the speaker unit toward the sound emission path. The microphone is installed in the microphone installation groove. Also, the microphone-mounted earphone further includes a cover configured to cover the microphone installation groove not to allow the microphone to be exposed outward.

The microphone-mounted earphone may further include a substrate on which the microphone is mounted. Here, the substrate may be mounted on a bottom surface of the microphone installation groove.

A microphone hole of the microphone may be disposed toward the substrate. Here, first opening may be formed in the substrate at a position corresponding to the microphone hole. Also, second opening may be formed in the bottom surface to allow the sound emission path and the first opening to communicate with each other.

The first opening and the second opening may be disposed at positions which disaccord with each other. Here, a communication groove may be formed in the bottom surface from the second opening to a position corresponding to the first opening to allow the second opening and the first opening to communicate with each other.

The communication groove may be formed to have an L shape.

A third opening may be formed in the bottom surface to allow the sound emission path and an internal space of the microphone installation groove to communicate with each other. Also, a conduit may be formed in the housing to allow the internal space of the microphone installation groove and a space in the rear of the speaker unit in the housing to communicate with each other.

The conduit may be formed along an outside of the speaker unit from an inner surface, which faces a front of the earphone, among inner surfaces of the microphone installation groove.

A third opening may be formed in the bottom surface to allow the sound emission path and an internal space of the microphone installation groove to communicate with each other. Also, a fourth opening may be formed in the cover to allow the internal space of the microphone installation groove to communicate with the outside.

The microphone-mounted earphone may further include a mesh member configured to cover the fourth opening.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1:
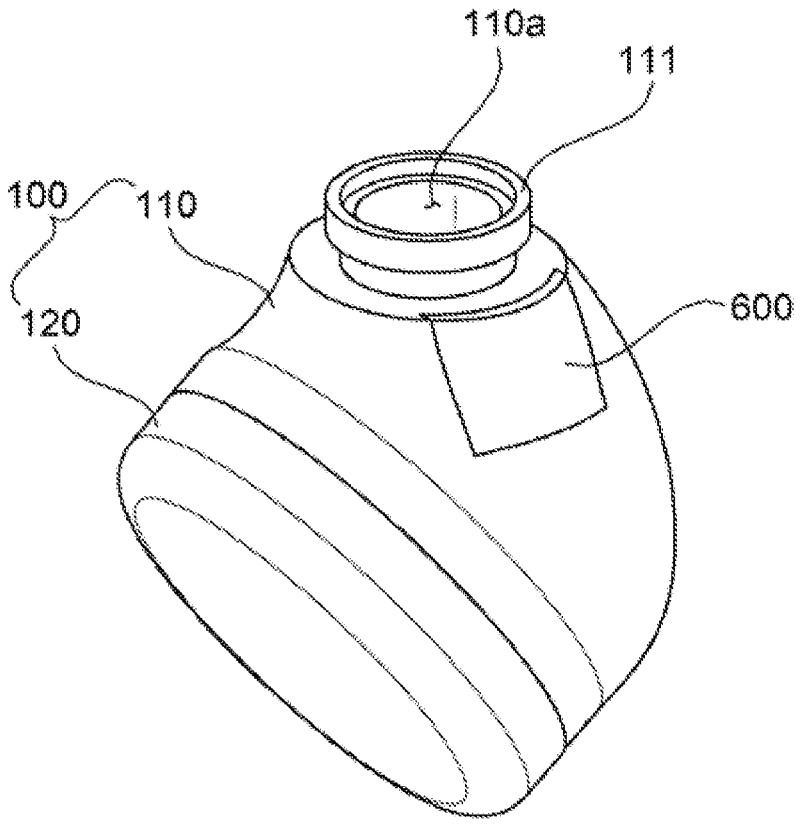
FIG. 1 is a perspective view of an earphone according to a first embodiment of the present invention.

Hereinafter, exemplary embodiments of the present invention will be described in detail with reference to the drawings. Hereinafter, throughout the description and the attached drawings, substantially like elements will be referred to as like reference numerals and a repetitive description thereof will be omitted. Also, in a description of the embodiments of the present invention, a detailed description of well-known functions or components of the related art will be omitted when it is deemed to obscure understanding of the embodiments of the present invention.

An earphone according to embodiments of the present invention includes at least one microphone which receives external noise for active noise cancellation (ANC). The earphone according to the embodiments of the present invention is a wireless earphone, but the present invention may be applied to a wired earphone as well as a wireless earphone.

Figure 2:
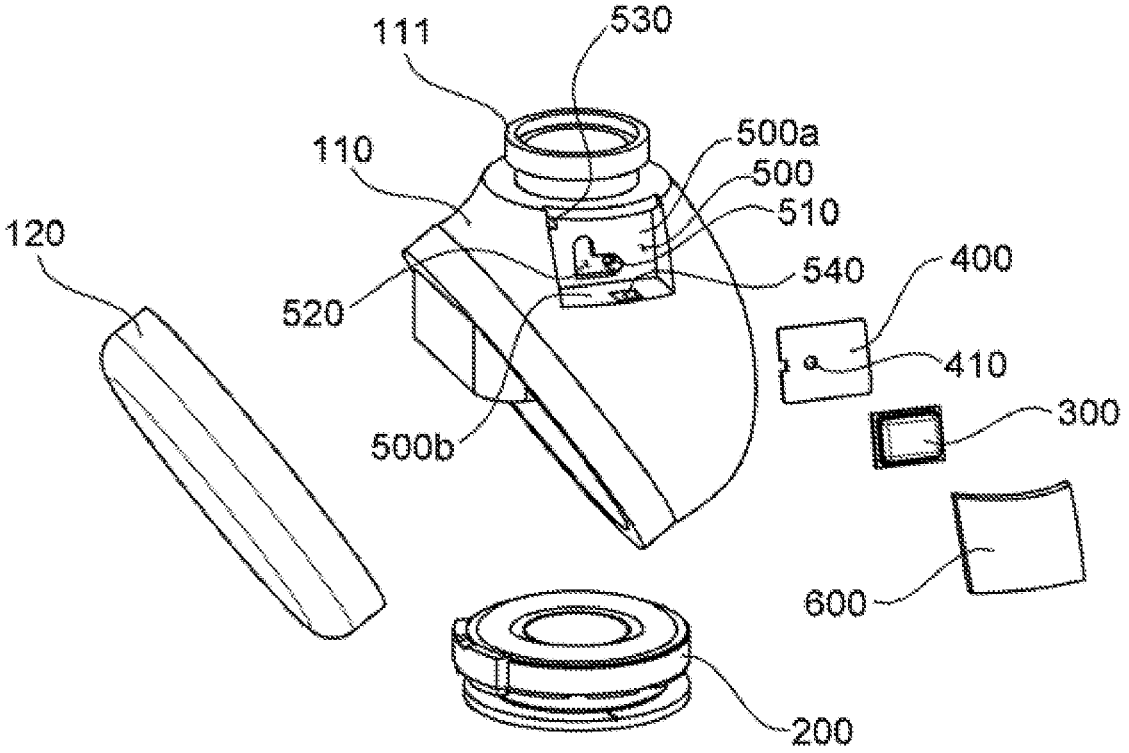
FIG. 2 is an exploded view of the earphone according to the first embodiment of the present invention.
Figure 3:
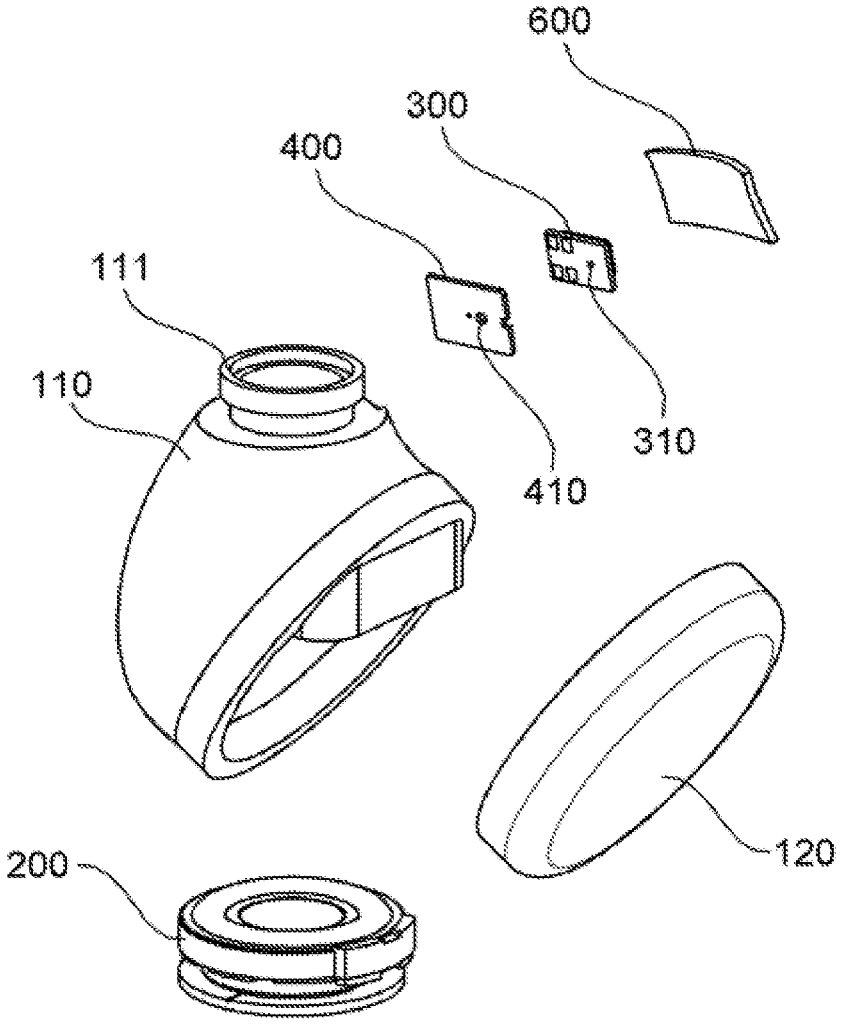
FIG. 3 is a view of the earphone of FIG. 2 when viewed from a different direction.
Figure 4:
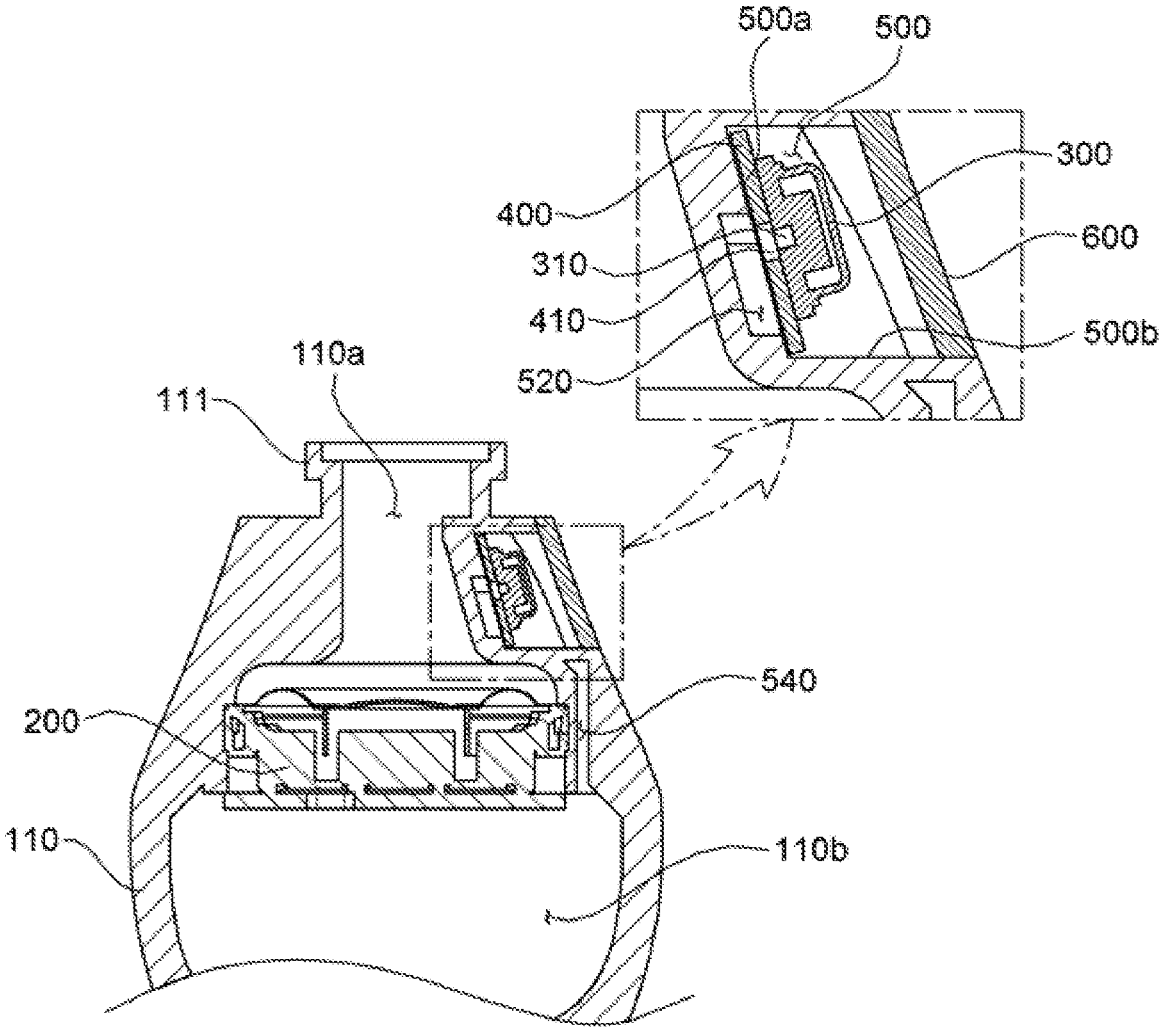
FIG. 4 is a first cross-sectional view of the earphone according to the first embodiment of the present invention.
Figure 5:
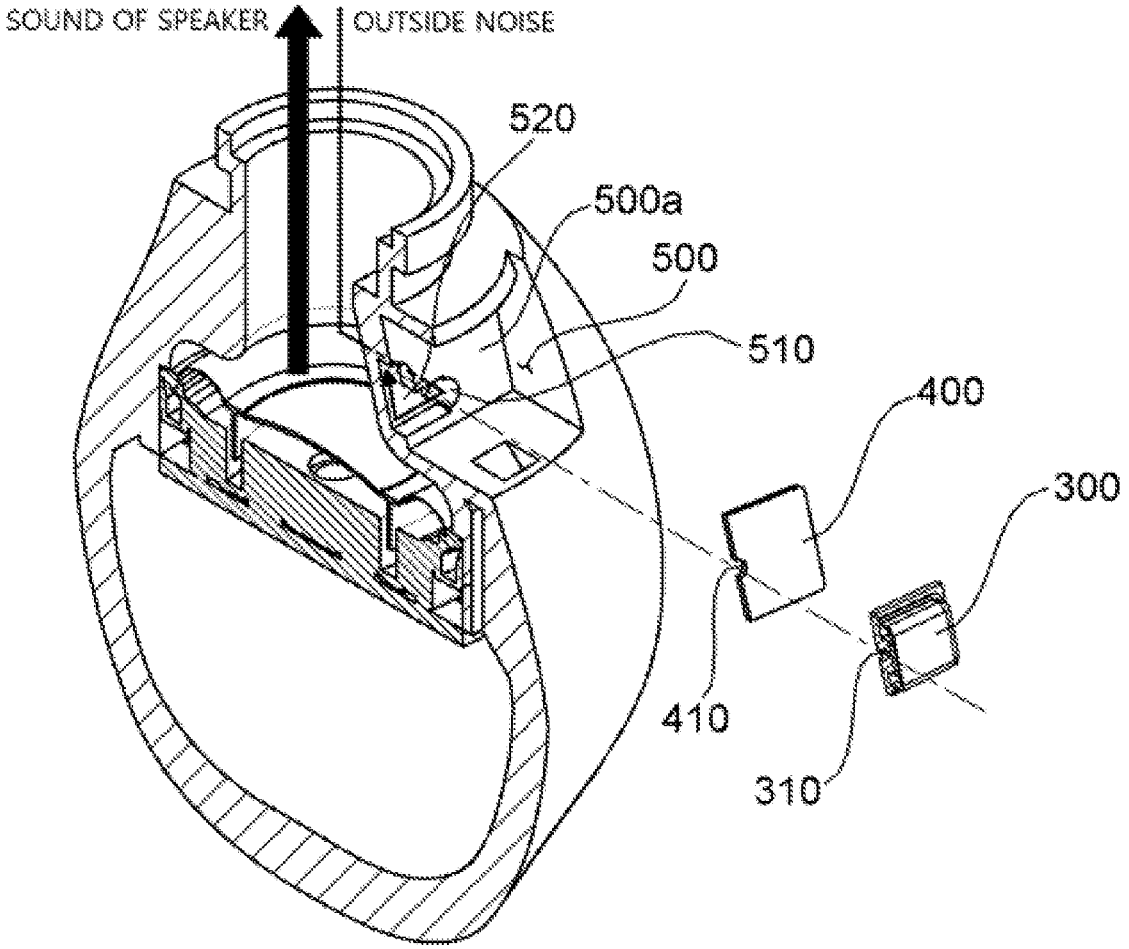
FIG. 5 is a second cross-sectional view of the earphone according to the first embodiment of the present invention.
Figure 6:
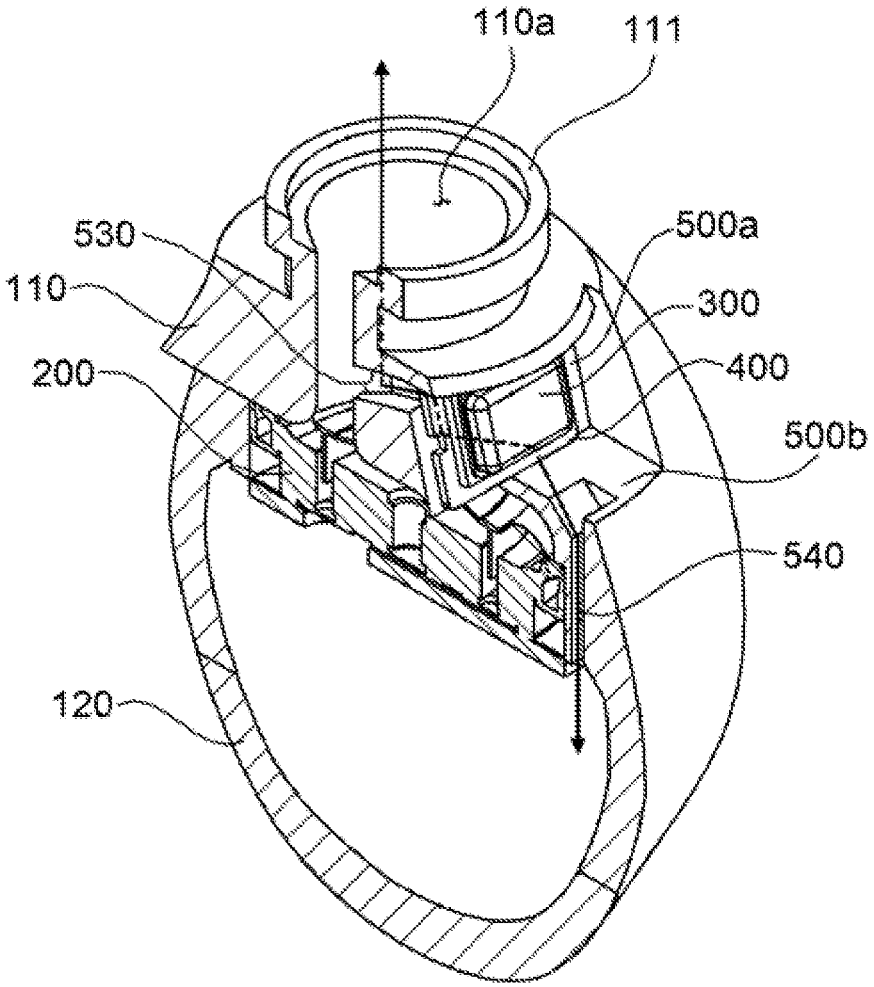
FIG. 6 is a third cross-sectional view of the earphone according to the first embodiment of the present invention.

FIGS. 1 to 6 are views of an earphone according to a first embodiment of the present invention. FIG. 1 is a perspective view of the earphone according to the first embodiment of the present invention, FIG. 2 is an exploded view of the earphone according to the first embodiment of the present invention, FIG. 3 is a view of the earphone of FIG. 2 when viewed from a different direction, FIG. 4 is a first cross-sectional view of the earphone according to the first embodiment of the present invention, FIG. 5 is a second cross-sectional view of the earphone according to the first embodiment of the present invention, and FIG. 6 is a third cross-sectional view of the earphone according to the first embodiment of the present invention.

The earphone according to the embodiment may include a housing 100, a speaker unit 200, a microphone 300, a substrate 400, and a cover 600.

The housing 100 may be formed by coupling a first housing 110 having an open bottom to a second housing 120 having an open top. The first housing 110 may include a nozzle 111 which emits a sound output from the speaker unit 200.

The speaker unit 200 generates a sound by converting an electrical signal input from the outside. The speaker unit 200 may be accommodated in the first housing 110.

Although not shown in the drawings, the earphone according to the embodiment may further include a wireless communication module (for example, a Bluetooth module), an ANC module, electrical components including a variety of circuits and the like, a battery configured to supply power, and the like, which may be accommodated in the housing 100.

The first housing 110 includes a sound emission path 110*a* in front of the speaker unit 200 to externally emit a sound generated by the speaker unit 200. The nozzle 111 may form at least a part of the sound emission path 110*a*.

The microphone 300 receives external noise for ANC. The microphone 300 is mounted on the substrate 400. The substrate 400 may be electrically connected to the microphone and transmit an electrical signal to the microphone 300 or transmit an electrical signal to the microphone 300 to another component (fore example, the ANC module) of the earphone.

To mount the microphone 300 and the substrate 400, the first housing 110 includes a microphone installation groove 500 recessed from an outer surface in front of the speaker unit 200 toward the sound emission path 110*a*. Accordingly, the substrate 400 on which the microphone 300 is mounted may be mounted on a bottom surface 500*a* of the microphone installation groove 500 (that is, a surface facing the sound emission path 110*a*). The substrate 400 may be fixed to the bottom surface 500*a* using an adhesive, a double-sided tape, or the like.

The cover 600 may be coupled to the first housing 110 to cover the microphone installation groove 500 so that the microphone 300 is not exposed externally. A step between an outer surface of the first housing 110 and an outer surface of the cover 600 may be reduced or removed so as to give a feeling of allowing the cover 600 to be integrated with the first housing 110.

A microphone hole 310 of the microphone 300 may be disposed toward the substrate (that is, toward the bottom surface 500*a* and the sound emission path 110*a*). A first opening 410 may be formed in the substrate 400 at a position corresponding to the microphone hole 310. A second opening 510 may be formed in the bottom surface 500*a* so that the sound emission path 110*a* communicates with the first opening 410. Accordingly, noise input from the outside of the earphone to the sound emission path 110*a* may flow into the microphone hole 310 through the second opening 510 and the first opening 410.

The second opening 510 of the bottom surface 500*a* may be disposed at a position corresponding to the first opening 410 of the substrate 400 so as to linearly arrange the second opening 510, the first opening 410, and the microphone hole 310. In this case, when the earphone is flooded and water comes into the earphone, water flows from the sound emission path 110*a* to the microphone hole 310 through the second opening 510 and the first opening 410 such that the microphone 300 may not operate properly or be damaged. To prevent this, a waterproof member such as a waterproof mesh may be attached to the second opening 510 of the bottom surface 500*a*. However, the waterproof member may degrade sound-receiving performance of the microphone 300.

In the embodiment, to prevent water from flowing into the microphone hole 310 without using a waterproof member, the first opening 410 of the substrate 400 and the second opening 510 of the bottom surface 500*a* are disposed at positions which disaccord with each other and a communication groove 520 may be formed in the bottom surface 500*a* from the second opening 510 to a position corresponding to the first opening 410 to allow the second opening 510 and the first opening 410 to communicate with each other. Since the substrate 400 is located above the communication groove 520, the communication groove 520 forms a conduit between the second opening 510 and the first opening 410 and air stays in the conduit. Accordingly, even when water flows into the second opening 510, proceeding of the water which has flown thereinto may be blocked by the air staying in the conduit. Such effect may be further improved by forming the communication groove 520 to have an L shape as shown in FIGS. 2 to 5.

FIG. 5 illustrates emission of a sound from the speaker unit 200 toward the outside and an inflow of a sound from the outside into the microphone hole 310 in the earphone according to the embodiment. As shown in the drawing, a sound generated from the speaker unit 200 is emitted toward the outside of the housing 100 through the sound emission path 110*a* and the nozzle 111. Meanwhile, noise from the outside flows into the second opening 510 through the sound emission path 110*a*, passes through the first opening 410 of the substrate 400 via the L-shaped communication groove 520, and flows into the microphone hole 310 of the microphone 300.

Also, as shown in more detail in FIG. 6, a third opening 530 configured to allow the sound emission path 110*a* and an internal space of the microphone installation groove 500 to communicate with each other may be formed in the bottom surface 500*a* of the microphone installation groove 500. Also, a conduit 540 configured to allow the internal space of the microphone installation groove 500 and a space 110*b* in the rear of the speaker unit 200 in the housing 100 to communicate with each other may be formed along an outside of the speaker unit 200 from an inner surface 500*b* which faces a front of the earphone among inner surfaces of the microphone installation groove 500. The third opening 530 and the conduit 540 may relieve sense of difference which may be felt by a wearer of the earphone due to an increase in internal pressure caused by blocking an external auditory meatus and a space in front of the speaker unit in the earphone. As shown in the drawing, the space in front of the speaker unit 200 may communicate with the space 110*b* in the rear of the speaker unit 200 through the third opening 530, the internal space of the microphone installation groove 500, and the conduit 540 so as to prevent the space in front of the speaker unit 200 from being sealed.

In the earphone according to the embodiment, the microphone installation groove 500 recessed from the outer surface of the front of the speaker unit 200 toward the sound emission path 110*a* is formed in the housing 100 and the microphone 300 is installed in the microphone installation groove 500 so that miniaturization of earphone is facilitated without an additional space or separate component for mounting a microphone in the housing 100. Also, since it is possible to install the microphone 300 in the microphone installation groove 500 from outside the housing 100, a microphone mounting operation becomes very simplified and the microphone is precisely mountable at a desired position. In addition, since the microphone 300 is exposed before the cover 600 is coupled, it is possible to very simply perform an electrical test, an exterior inspection, and the like on the installed microphone 300.

Figure 7:
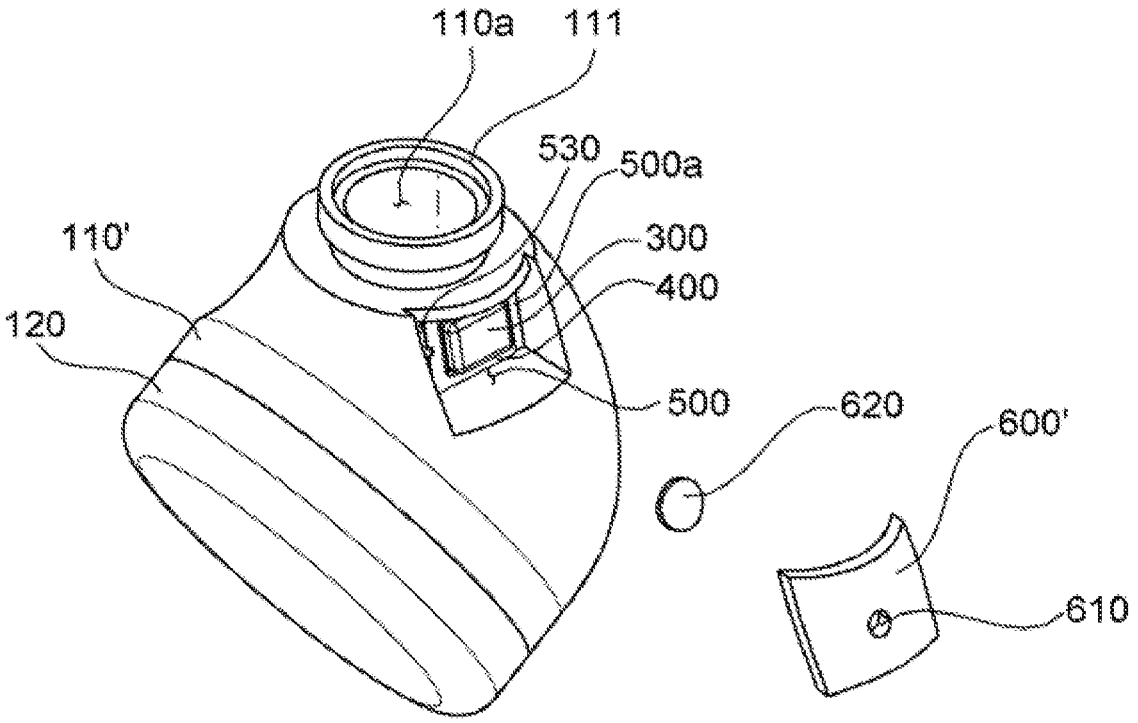
FIG. 7 is an exploded view of an earphone according to a second embodiment of the present invention.
Figure 8:
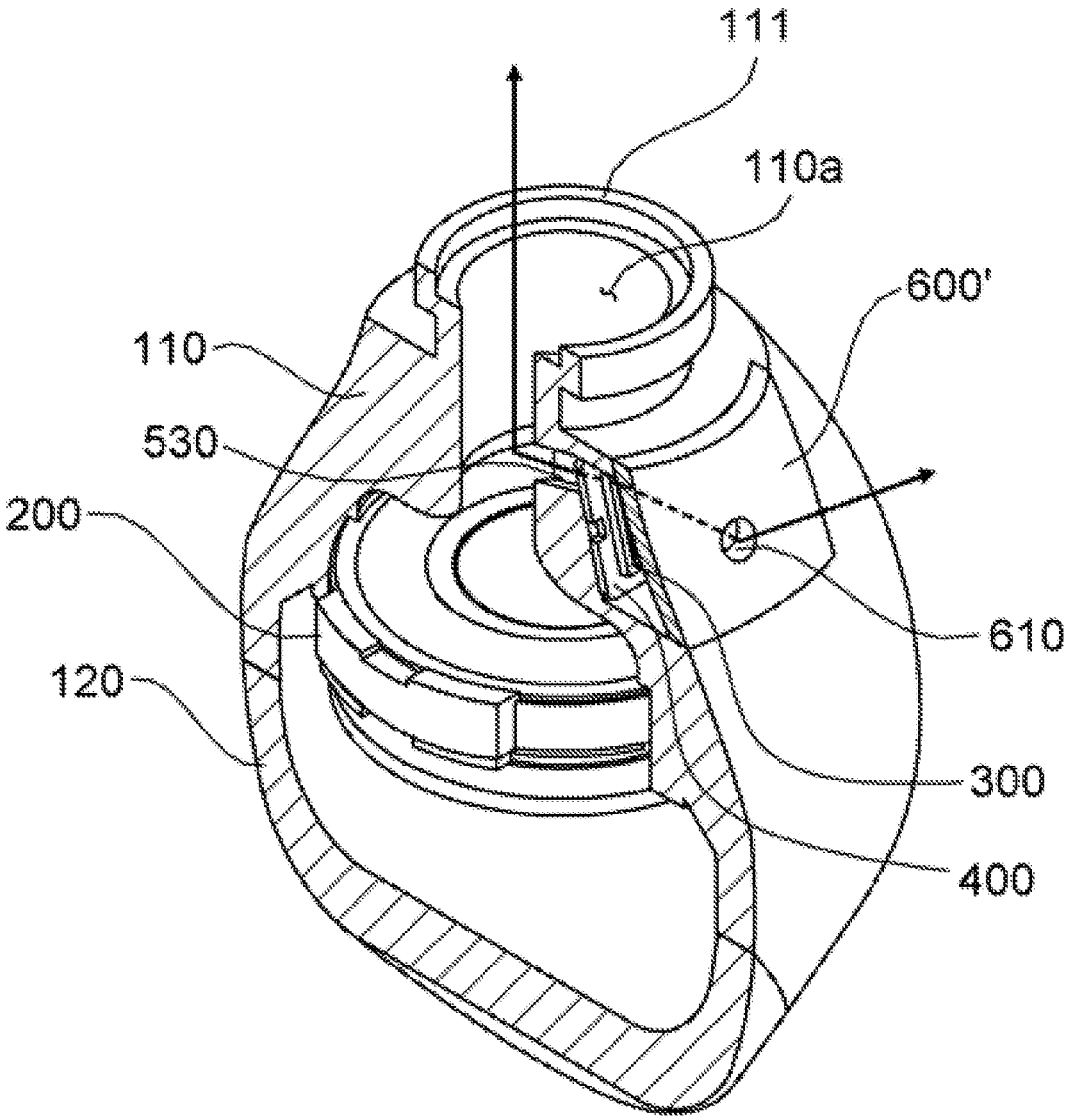
FIG. 8 is a cross-sectional view of the earphone according to the second embodiment of the present invention.

FIGS. 7 and 8 are views of an earphone according to a second embodiment of the present invention. FIG. 7 is an exploded view of the earphone according to the second embodiment of the present invention, and FIG. 8 is a cross-sectional view of the earphone according to the second embodiment of the present invention. Hereinafter, for convenience, differences from the first embodiment will be mainly described.

In comparison to the first embodiment, in the earphone according to the second embodiment, a fourth opening 610 is formed, instead of the conduit 540, in a cover 600' to allow an internal space of the microphone installation groove 500 to communicate with the outside of the earphone, and a mesh member 620 configured to cover the fourth opening 610 is further formed inside the cover 600'. The third opening 530 and the fourth opening 610 may relieve sense of difference which may be felt by a wearer of the earphone due to an increase in internal pressure caused by blocking an external auditory meatus and a space in front of the speaker unit in the earphone. As shown in FIG. 8, the space in front of the speaker unit 200 may communicate with the outside of the earphone through the third opening 530, the internal space of the microphone installation groove 500, and the fourth opening 610 so as to prevent the space in front of the speaker unit 200 from being sealed. The mesh member 620 is for waterproofing and may prevent water from flowing into the microphone installation groove 500 through the fourth opening 610.

However, the second embodiment does not exclude the conduit 540 of the first embodiment. That is, the conduit 540 may be formed alongside the fourth opening 610 in the cover 600'. In this case, the space in front of the speaker unit 200 may communicate with the space 110*b* in the rear of the speaker unit 200 through the third opening 530, the internal space of the microphone installation groove 500, and the conduit 540 or communicate with the outside of the earphone through the third opening 530, the internal space of the microphone installation groove 500, and the fourth opening 610.

Figure 9:
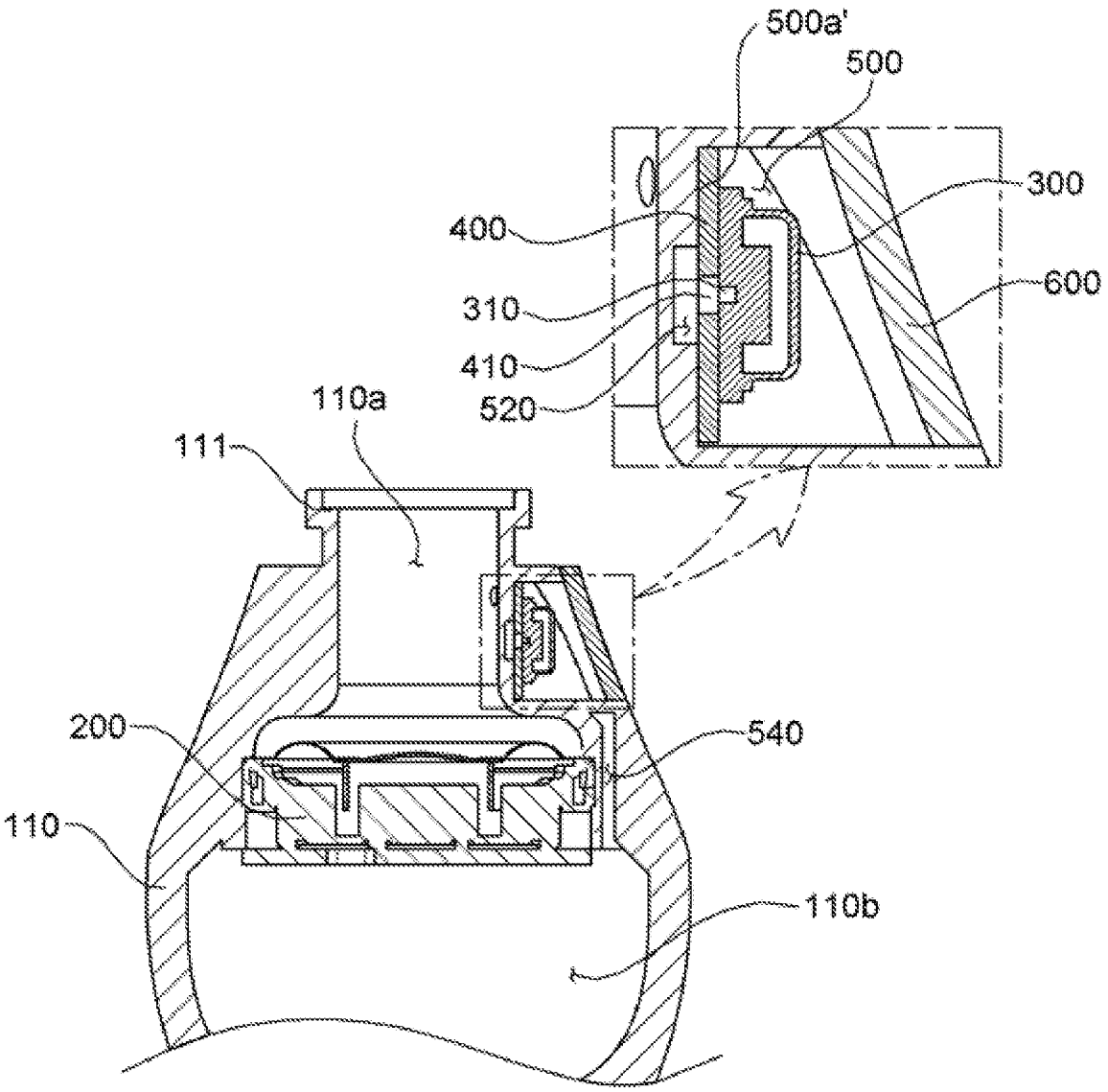
FIG. 9 is a cross-sectional view of an earphone according to a third embodiment of the present invention.

FIG. 9 is a cross-sectional view of an earphone according to a third embodiment of the present invention. Hereinafter, for convenience, differences from the first embodiment will be mainly described.

According to the first embodiment, the bottom surface 500*a* of the microphone installation groove 500 is formed to be slightly tilted toward the sound emission path 110*a* so that a protruding portion is formed on an inner circumferential surface of the sound emission path 110*a*. On the other hand, in the third embodiment, a bottom surface 500*a'* of the microphone installation groove 500 is formed to be parallel to the sound emission path 110*a* so that a protruding portion is not formed on the inner circumferential surface of the sound emission path 110*a*. That is, the microphone installation groove 500 may be installed only using a thickness between the inner circumferential surface of the sound emission path 110*a* and the outer surface of the first housing 110. In the third embodiment, since there is no deformation (protruding portion) in the sound emission path 110*a*, there is lesser influence on sound quality than that of the first embodiment. However, an influence of the deformation of the sound emission path 110*a* in the first embodiment on sound quality may be very insignificant.

According to the present invention, there are advantages of facilitating miniaturization and assembling of an earphone and of minimizing deterioration in sound quality caused by a microphone and a mounting structure thereof The exemplary embodiments of the present invention have been described above. It should be understood by one of ordinary skill in the art that the present invention may be implemented as a modified form without departing from the essential features of the present invention. Therefore, the disclosed embodiments should be considered not in a limitative view but a descriptive view. The scope of the present invention will be shown in the utility model registration claims not in the above description, and all differences within an equivalent range thereof should be construed as being included in the present invention.

What is claimed is:

1. A microphone-mounted earphone comprising:

a housing;

a speaker unit accommodated in the housing;

a microphone; and a substrate on which the microphone is mounted, wherein the housing comprises a sound emission path formed in front of the speaker unit to emit a sound generated by the speaker unit toward the outside, wherein the housing comprises a microphone installation groove recessed from an outer surface of a front of the speaker unit toward the sound emission path, wherein the microphone is installed in the microphone installation groove, wherein the substrate is mounted on a bottom surface of the microphone installation groove, and the microphone-mounted earphone further comprising a cover configured to cover the microphone installation groove not to allow the microphone to be exposed outward.

2. The microphone-mounted earphone of claim 1, wherein a microphone hole of the microphone is disposed toward the substrate, wherein a first opening is formed in the substrate at a position corresponding to the microphone hole, and wherein a second opening is formed in the bottom surface to allow the sound emission path and the first opening to communicate with each other.

3. The microphone-mounted earphone of claim 2, wherein the first opening and the second opening are disposed at positions which disaccord with each other, and wherein a communication groove is formed in the bottom surface from the second opening to a position corresponding to the first opening to allow the second opening and the first opening to communicate with each other.

4. The microphone-mounted earphone of claim 3, wherein the communication groove is formed to have an L shape.

5. The microphone-mounted earphone of claim 2, wherein a third opening is formed in the bottom surface to allow the sound emission path and an internal space of the microphone installation groove to communicate with each other, and wherein a conduit is formed in the housing to allow the internal space of the microphone installation groove and a space in the rear of the speaker unit in the housing to communicate with each other.

6. The microphone-mounted earphone of claim 5, wherein the conduit is formed along an outside of the speaker unit from an inner surface, which faces a front of the earphone, among inner surfaces of the microphone installation groove.

7. The microphone-mounted earphone of claim 2, wherein a third opening is formed in the bottom surface to allow the sound emission path and an internal space of the microphone installation groove to communicate with each other, and wherein a fourth opening is formed in the cover to allow the internal space of the microphone installation groove to communicate with the outside.

8. The microphone-mounted earphone of claim 7, further comprising a mesh member configured to cover the fourth opening.

* * * * *